United States Patent [19]

Yoshiike

[11] Patent Number: 5,075,603

[45] Date of Patent: Dec. 24, 1991

[54] COLD-CATHODE DISCHARGE LAMP DEVICE

[75] Inventor: Yoshiji Yoshiike, Yokosuka, Japan

[73] Assignee: Kabushiki Kaisha Toshiba, Kawasaki, Japan

[21] Appl. No.: 270,256

[22] Filed: Nov. 14, 1988

[30] Foreign Application Priority Data

Nov. 13, 1987 [JP] Japan ..... 62-288148

[51] Int. Cl.[5] ..... H05B 41/22

[52] U.S. Cl. ..... 315/335; 315/150; 313/607

[58] Field of Search ..... 315/150, 335; 313/8, 313/607, 635, 291; 355/67

[56] References Cited

U.S. PATENT DOCUMENTS

| | | | |
|---|---|---|---|
| 1,990,175 | 2/1935 | Roulke | 315/150 X |
| 2,774,918 | 12/1956 | Lemmers | 315/335 X |
| 2,864,035 | 12/1958 | Davis | 315/335 X |
| 3,452,231 | 6/1969 | Sell | 313/8 |
| 3,890,540 | 6/1975 | Ott | 315/335 |
| 3,983,385 | 9/1976 | Troue | 355/67 X |
| 4,128,332 | 12/1978 | Rowe | 355/67 |
| 4,555,648 | 11/1985 | Iida et al. | 315/150 X |
| 4,695,152 | 9/1987 | Urso, Jr. | 355/67 X |
| 4,721,888 | 1/1988 | Proud et al. | 315/150 X |
| 4,818,915 | 4/1989 | Zaslavsky et al. | 315/150 X |
| 4,899,090 | 2/1990 | Yoshiike et al. | 315/335 |

FOREIGN PATENT DOCUMENTS

| | | |
|---|---|---|
| 30-7478 | 5/1955 | Japan . |
| 35-12740 | 9/1960 | Japan . |
| 60-34220 | 8/1985 | Japan . |

*Primary Examiner*—Eugene R. LaRoche
*Assistant Examiner*—Do Hyun Yoo
*Attorney, Agent, or Firm*—Cushman, Darby & Cushman

[57] ABSTRACT

A cold-cathode discharge lamp device including a cold-cathode discharge lamp unit and a supplemental light source for emitting light toward a discharge space between a pair of cold-electrodes of the discharge lamp unit for producing initial electrons in the discharge space.

9 Claims, 1 Drawing Sheet

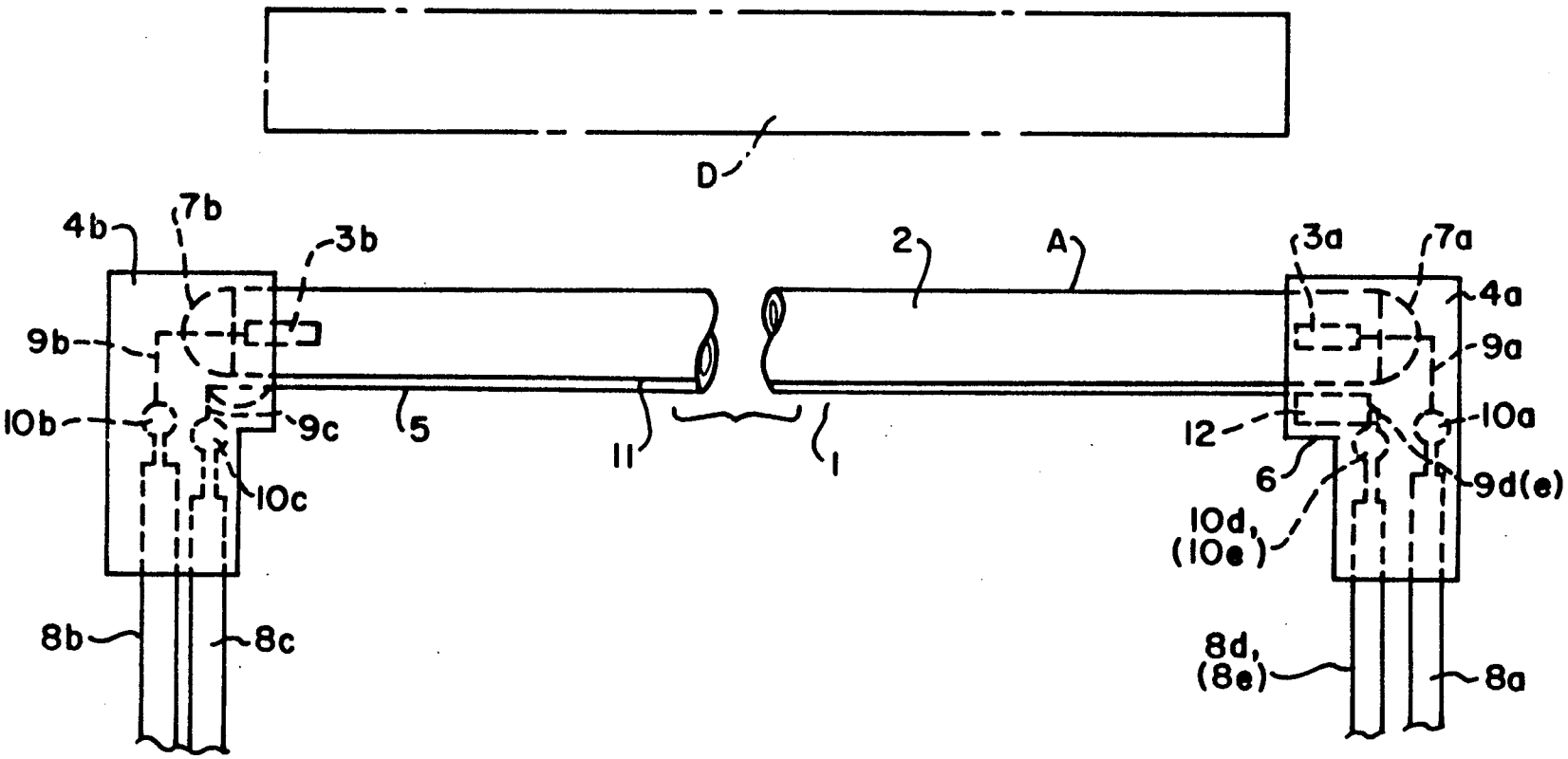
4a
9a
10a
9d(e)
8a
7a
3a
6
12
10d,
(10e)
8d,
(8e)
A
2
1
D
11
5
3b
9c
10c
8c
7b
4b
9b
10b
8b

COLD-CATHODE DISCHARGE LAMP DEVICE

FIELD OF THE INVENTION

The present invention relates to a cold-cathode discharge lamp device, and more particularly to, a cold-cathode discharge lamp device with an improved darkness characteristic.

BACKGROUND OF THE INVENTION

A cold-cathode discharge lamp is used as a light source in many fields, e.g. in the field of office machines, such as copying machine. The cold-cathode discharge lamp has the merit of compactness in size, but has a demerit in its ability to start discharge lighting in darkness (this ability will be referred as the darkness characteristic hereafter).

As is well known, the cathode of the cold-cathode discharge lamp is not preheated at the start of discharge lighting. The cold-cathode discharge lamp starts its discharge lighting with the aid of environmental light. Generally, environmental light becomes a seed of initial electrons for causing discharge lighting in a discharge lamp, when the discharge lamp is activated to start the discharge lighting.

The cold-cathode discharge lamp used in a copying machine is mounted at a dark position in the machine. In this case, the lamp cannot rely on environmental light. Thus, the cold-cathode discharge lamp must have a supplemental means for producing initial electrons therein or near the lamp.

In conventional cold-cathode discharge lamps, it is known to provide a radioactive element, e.g., a salt compound of promethium$_{147}$Pm, in the lamp bulb. Radioactive rays emitted from the salt compound of promethium$_{147}$Pm produce electrons in the lamp bulb. Then, the discharge lighting can start immediately with the aid of the radioactive rays even if the cold-cathode discharge lamp is located in a dark place. Thus, the darkness characteristic of the cold-cathode discharge lamp is improved.

In this conventional cold-cathode discharge lamp, a relatively small amount of the radioactive element is sealed in the lamp bulb, so as not to cause a serious problem to the human body. For example, about $10^{-16}$ grams of the salt compound of promethium$_{147}$Pm is sealed in the lamp bulb. If a large amount of the radioactive element is used, serious problems can be caused to the human body by the radioactive rays emitted outside the bulb. If a small amount of the radioactive element is used in the lamp bulb, the darkness characteristics can become poor.

SUMMARY OF THE INVENTION

It is, therefore, an object of the present invention to provide a cold-cathode discharge lamp device with an improved darkness characteristic.

In order to achieve the above object, a cold-cathode discharge lamp device according to one aspect of the present invention includes a cold-cathode discharge lamp unit having an enclosure sealed with a discharge gas and a pair of non-preheated discharge electrodes provided in the enclosure, the discharge electrodes being spaced apart from each other for defining a discharge space therebetween and a supplemental light source which emits light toward the discharge space for starting discharge between the discharge electrodes.

Additional objects and advantages of the present invention will be apparent to persons skilled in the art from a study of the following description and the accompanying drawings, which are hereby incorporated in and constitute a part of this specification.

BRIEF DESCRIPTION OF THE DRAWING

A more complete appreciation of the invention and many of the attendant advantages thereof will be readily obtained as the same becomes better understood by reference to the following detailed description when considered in connection with the accompanying drawing.

The drawing is a side elevation showing an embodiment of the cold-cathode discharge lamp device according to the present invention.

DESCRIPTION OF THE PREFERRED EMBODIMENTS

An embodiment of the present invention is explained hereinafter referring to the attached drawing.

The embodiment of the cold-cathode discharge lamp device comprises a discharge lamp unit 1. The discharge lamp unit 1 comprises a lamp bulb 2, a pair of discharge electrodes 3*a* and 3*b*, a pair of lamp bases 4*a* and 4*b*, a discharge stabilizer 5 and a discharge starter 6.

The lamp bulb 2 is made of a slender hollow glass tube with a thickness of around ten millimeters. An inner surface of the lamp bulb 2 is coated with a fluorescent film which is not illustrated in the drawing. Both ends 7*a* and 7*b* of the lamp bulb 2 are hermetically sealed. The sealed space of the lamp bulb 2 is filled with a conventional discharge gas, e.g., xenon gas, krypton gas or mercury vapor.

The discharge electrodes 3*a* and 3*b* are provided in the lamp bulb 2 supported on the sealed ends 7*a* and 7*b*, respectively. These discharge electrodes 3*a* and 3*b* are coated with electron emittive material, such as barium nitride BaN, etc. These discharge electrodes 3*a* and 3*b* are coupled to power supply cords 8*a* and 8*b* through lead wires 9*a* and 9*b*, respectively. The lead wires 9*a* and 9*b* are connected to the power supply cords 8*a* and 8*b* by solderings 10*a* and 10*b*. The discharge lamp unit 1 has an illumination surface A defined on the lamp bulb 2 along the axis of the lamp bulb 2 for illuminating an object, e.g., a light sensitive drum D of a copying machine.

The lamp bases 4*a* and 4*b* are provided for mechanically coupling the cold-cathode discharge lamp 1 to a prescribed apparatus, e.g., a copying machine. The lamp bases 4*a* and 4*b* are fixed to the sealed ends 7*a* and 7*b*, respectively.

The lamp bases 4*a* and 4*b* also house the lead wires 9*a* and 9*b* and respective ends of the power supply cords 8*a* and 8*b* . Thus, they are protected by the lamp bases 4*a* and 4*b*.

The discharge stabilizer 5 is provided for depressing flickers of a positive column (not shown) which occurs between the discharge electrodes 3*a* and 3*b* in the discharge lighting. The discharge stabilizer 5 comprises a stabilizer electrode 11. The stabilizer electrode 11 is coated on the outer surface of the lamp bulb 2 with a strip line shape along the axial direction of the lamp bulb 2.

A prescribed potential is applied between the stabilizer electrode 11 and one of the discharge electrodes, e.g., the discharge electrode 3*b*, so that flickers of the positive column are depressed. One end of the stabilizer electrode 11 is coupled to a power supply cord 8*c* through a lead wire 9*c*. The lead wire 9*c* is connected to the power supply cord 8*c* by a soldering 10*c*. The lead wire 9*c* and the power supply cord 8*c* are also housed in one of the lamp bases, e.g., the lamp base 4*b*.

The discharge starter 6 comprises a small light source 12, e.g., an incandescent lamp, an LED (Light Emitting Diode), an EL (Electro Luminescent) lamp, etc. A pair of lead wires 9*d* and 9*e* of the light source 12 are coupled to a pair of power supply cords 8*d* and 8*e* by solderings 10*d* and 10*e*. In the drawing, each one of the power supply cords, the lead wires and the solderings, e.g., 9*d*, 8*d* and 10*d* are illustrated. The others of the power supply cords, the lead wires and the solderings, e.g., 9*e*, 8*e* and 10*e* overlap the corresponding elements 9*d*, 8*d* and 10*d*.

The light source 12 is mounted in one of the lamp bases 4*a* and 4*b*, e.g., the lamp base 4*b* in a prescribed position opposite to the illumination surface A in reference to the discharge electrode 3*b*. The lamp base 4*a* also houses the lead wires 9*d* and 9*e*, the power supply cords 8*d* and 8*e* and a part of the solderings 10*d* and 10*e* together with the light source 12.

The light source 12 and the discharge lamp unit 1 are coupled to a prescribed power supply means (not shown) through the power supply cords 8*a* through 8*d*. When the power supply means is activated, prescribed potentials are given to the discharge electrodes 3*a* and 3*b* of the discharge lamp unit 1, the stabilizer electrode 11 of the discharge stabilizer 5 and the light source 12.

Now the operation of the cold-cathode discharge lamp device of the drawing will be described. When the power supply means is activated, the light source 12 immediately starts to emit the light. The light emitted from the light source 12 makes the discharge gas around the discharge electrode 3*a* in the lamp bulb 2 activate. Thus, a photoelectric conversion takes place in the discharge gas by the illumination.

According to the photoelectric conversion, some amount of initial electrons are produced around the discharge electrode 3*b*. The initial electrons are accelerated by the electric field between the discharge electrodes 3*a* and 3*b*. The accelerated electrons collide with molecules of the discharge gas sealed in the lamp bulb 2. Thus, further electrons, e.g., secondary electrons, are produced according to the collision. The initial electrons and the secondary electrons again produce further electrons one by one. Thus, electrons propagate rapidly in the lamp bulb 2.

When the electrons propagate in a sufficient amount, a discharge takes place between the discharge electrodes 3*a* and 3*b* in the lamp bulb 2.

According to the embodiment of the present invention as described above, the light radiated from the discharge starter 6, i.e., the light source 12, produces electrons in the discharge lamp unit 1. Thus, initial electrons as a seed necessary for starting the discharge lighting are securely obtained. As a result, the cold-cathode discharge lamp device can securely and rapidly start the discharge lighting, although the device is located in a dark place. In other words, the cold-cathode discharge lamp device according to the present invention has an improved darkness characteristic.

The discharge starter 6 faces the discharge electrode 3*b*, but the starter 6 is housed in the lamp base 4*a*. Light radiation from the discharge starter 6 to the outside of the cold-cathode discharge lamp device is restrained. In some office machines, light other than the light emitted from the discharge lamp unit is required to be masked. For office machines, the embodiment of the cold-cathode discharge lamp device has good adaptability.

For the same object or other objects, the light source 12, i.e., the discharge starter 6, can be deactivated after the discharge lighting has taken place in the discharge lamp unit 1. The timed operation of the discharged starter 6 can be made in a known manner, such as by use of a delay device.

In case of the discharge electrode 3*b* having a plate shape, the discharge starter 6 can be aligned with the surface of the plate shaped discharge electrode 3*b*.

In the embodiment, the discharge starter 6 is provided in the lamp base 4*a*, but the present invention is not limited to this arrangement. The discharge starter 6 may be provided at any position facing the discharge space of the discharge lamp unit 1, e.g., on the glass tube 2. Further, a plurality of discharge starters, e.g., two discharge starters, can be provided in the pair of the lamp bases, respectively.

As described above, the present invention can provide an extremely preferable cold-cathode discharge lamp device.

While there have been illustrated and described what are at present considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation or material to the teaching of the present invention without departing from the central scope thereof. Therefore, it is intended that the present invention not be limited to the particular embodiment disclosed as the best mode contemplated for carrying out the present invention, but that the present invention includes all embodiments falling within the scope of the appended claims.

What is claimed is:

1. A cold-cathode discharge lamp device for illuminating an object, comprising:

an enclosure having a discharge gas and a pair of non-preheated discharge electrodes therein, the discharge electrodes being spaced apart from each other for defining a discharge space therebetween;

means positioned near one of said electrodes for starting discharge between the discharge electrodes, the discharge starting means having a light source for emitting light toward the discharge space, said light source not requiring any initial electrons in order to emit light; and a stabilizer electrode coated on a surface of the enclosure with a strip line shape and extending in the vicinity of said discharge starting means and one of said pair of non-preheated electrodes.

2. The cold-cathode discharge lamp device of claim 1 also including a lamp base for mechanically coupling the cold-cathode discharge lamp device, and wherein the light source is housed in the lamp base.

3. The cold-cathode discharge lamp device of claim 1 wherein at least one of the electrodes is plate shaped, and the light source is mashed by the plate shaped discharge electrode.

4. The cold-cathode discharge lamp device of claim 1 wherein the starting means includes a plurality of the light sources, each for emitting light toward the discharge space.

5. The cold-cathode discharge lamp device of claim 2 wherein the starting means includes a pair of the light sources, each for emitting light toward the discharge space.

6. The cold-cathode discharge lamp device of claim 5 including a pair of the lamp bases for mechanically coupling the cold-cathode discharge lamp device, and wherein the one of the light sources is housed in each of the lamp bases.

7. The cold-cathode discharge lamp device of claim 1 wherein the light source includes at least an incandescent lamp.

8. The cold-cathode discharge lamp device of claim 1 wherein the light source includes at least an emitting diode.

9. The cold-cathode discharge lamp device of claim 1 wherein the light source includes at least an electro luminescent lamp.

* * * * *